US009259959B2

(12) United States Patent
Clement et al.

(10) Patent No.: US 9,259,959 B2
(45) Date of Patent: Feb. 16, 2016

(54) METHODS FOR MANUFACTURING PANELS AND PANEL OBTAINED HEREBY

(75) Inventors: Benjamin Clement, Waregem (BE); Christophe Maesen, Lichtervelde (BE)

(73) Assignee: FLOORING INDUSTRIES LIMITED, SARL, Bertrange (LU)

( * ) Notice: Subject to any disclaimer, the term of this patent is extended or adjusted under 35 U.S.C. 154(b) by 870 days.

(21) Appl. No.: 13/501,626

(22) PCT Filed: Sep. 15, 2010

(86) PCT No.: PCT/IB2010/054151

§ 371 (c)(1), (2), (4) Date: Apr. 12, 2012

(87) PCT Pub. No.: WO2011/045690

PCT Pub. Date: Apr. 21, 2011

(65) Prior Publication Data

US 2012/0213973 A1 Aug. 23, 2012

(30) Foreign Application Priority Data

Oct. 14, 2009 (BE) ..... 2009/0626

(51) Int. Cl.

| | |
|---|---|
| ***B05D 7/08*** | (2006.01) |
| ***C08L 61/20*** | (2006.01) |
| ***B44C 5/04*** | (2006.01) |
| *E04F 15/02* | (2006.01) |

(52) U.S. Cl.

CPC . *B44C 5/043* (2013.01); *B44C 5/04* (2013.01); *E04F 15/02* (2013.01); *Y10T 428/24521* (2015.01); *Y10T 428/24868* (2015.01)

(58) Field of Classification Search

CPC ..... B05D 7/08; C08L 61/20
USPC ..... 427/393, 397, 532, 553, 551, 557; 524/212

See application file for complete search history.

(56) References Cited

U.S. PATENT DOCUMENTS

| | | | | |
|---|---|---|---|---|
| 1,971,067 | A | 8/1934 | Fess | |
| 3,634,347 | A * | 1/1972 | Kao | 524/40 |
| 3,975,572 | A * | 8/1976 | Power | B32B 29/00 156/278 |
| 4,126,594 | A * | 11/1978 | Peters et al. | 524/389 |
| 4,473,613 | A * | 9/1984 | Jaisle | B32B 29/06 156/307.1 |
| 2002/0014297 | A1 * | 2/2002 | Mott | B32B 5/20 156/78 |
| 2004/0191547 | A1 * | 9/2004 | Oldorff | 428/479.3 |
| 2005/0003099 | A1 * | 1/2005 | Quist et al. | 427/532 |
| 2010/0307675 | A1 * | 12/2010 | Buhlmann | 156/272.2 |

FOREIGN PATENT DOCUMENTS

| | | |
|---|---|---|
| DE | 662934 | 7/1938 |
| DE | 1243061 | 6/1967 |
| DE | 19532819 A1 | 3/1997 |
| DE | 19725829 C1 * | 8/1998 |

(Continued)

*Primary Examiner* — Cachet Sellman

(74) *Attorney, Agent, or Firm* — Capitol City TechLaw

(57) ABSTRACT

A method for manufacturing panels of the type which is at least composed of a substrate and a top layer provided on the substrate, the top layer includes at least two material layers, amongst which a print, the method may involve applying the two material layers, such that the print is performed directly on the substrate and the print forms at least a portion of a printed decor. At least one of the two material layers may include a mixture having at least a thermally curing component and a radiation-curing component.

22 Claims, 2 Drawing Sheets

(56) References Cited

FOREIGN PATENT DOCUMENTS

| | | | |
|---|---|---|---|
| DE | 102004009160 | A1 | 9/2005 |
| DE | 202005015978 | U1 | 3/2007 |
| EP | 1454763 | A2 | 9/2004 |
| EP | 1872959 | A1 | 1/2008 |
| EP | 2045393 | A1 | 4/2009 |
| GB | 1003597 | | 9/1965 |
| GB | 1035256 | | 7/1966 |
| WO | 9747834 | A1 | 6/1997 |
| WO | 0148333 | A1 | 7/2001 |
| WO | 0200449 | A1 | 1/2002 |
| WO | 2004042168 | A1 | 5/2004 |
| WO | WO 2004042168 | A1 * | 5/2004 |

* cited by examiner

METHODS FOR MANUFACTURING PANELS AND PANEL OBTAINED HEREBY

BACKGROUND

1. Field

This invention relates to methods for manufacturing panels, as well as to panels which can be obtained by means of such methods.

More particularly, the invention relates to methods for manufacturing panels of the type which is at least composed of a substrate and a top layer provided on this substrate and comprising a printed decor. Herein, this may relate, for example, to furniture panels, ceiling panels, floor panels or the like, which substantially consist of an MDF or HDF (Medium or High Density Fiberboard) basic panel or substrate and a top layer provided thereon. In particular, it relates to a method wherein one or more material layers are provided on the substrate, wherein at least one of these material layers is provided by means of a print performed directly on the substrate, wherein this print then forms at least a portion of said printed decor.

2. Related Art

Such panels are known as such, for example, from U.S. Pat. No. 1,971,067 or DE 195 32 819 A1. From the above documents, it is also known that said material layers may comprise one or more primer layers, wherein these primer layers extend substantially underneath said print, and/or may comprise one or more finishing layers, which extend substantially above said print. Such finishing layers may comprise, for example, transparent or translucent synthetic material layers, which form a protective layer above the printed decor and can comprise, for example, wear-resistant particles, such as aluminum oxide. It is not excluded that this protective layer comprises a material sheet, such as a paper sheet.

The state of the art in connection with panels which are provided with a print performed directly on the substrate further becomes clear from the documents WO 01/48333, WO 02/00449, WO 2004/042168, EP 1 454 763, DE 197 25 829 C1 and DE 10 2004 009 160 A1.

It is known, amongst others, from WO 01/48333, that either lacquers or synthetic resins may be applied for realizing said material layers. In the case of synthetic resins, these are applied by means of a carrier sheet, which has been provided beforehand with such synthetic resin and is provided on the substrate by means of a heated press. In the case of lacquers, for example, UV-curing lacquers can be applied.

It is known, amongst others, from DE 197 25 829 C1 or EP 1 454 763, that one or more synthetic resins applied in liquid form can be applied for realizing said material layers. After these resin layers are dried, they are cured in a heated press. By means of such method, paper-free top layers can be realized.

SUMMARY

The present invention, according to its various independent aspects, in first instance aims at offering alternative methods of the above-mentioned type, which, according to various preferred embodiments thereof, can be performed faster and/or more economical than the methods from the state of the art.

To this aim, the invention, according to its first independent aspect, relates to a method for manufacturing panels of the type which is at least composed of a substrate and a top layer provided on this substrate and comprising a printed decor, wherein the top layer comprises at least two material layers, amongst which a print, wherein the method consists at least of applying said two material layers, wherein said print is performed directly on the substrate material and this print forms at least a portion of said printed decor, with the characteristic that at least in one of said two material layers a mixture is realized which comprises at least a thermally curing component and a radiation-curing component. It is clear that by "directly", it is not excluded here that already one or more material layers can be provided on the substrate prior to performing the print. By "directly", it is namely meant that the printing operation takes place on the substrate and, for example, not on a separate carrier sheet, which afterwards is provided on the substrate.

By realizing a mixture of at least two components which show a mutually differing curing mechanism, possibilities are created for increasing the compatibility with material layers applied afterwards or beforehand. For example, by means of the respective material layer, the adherence between a layer, which substantially consists of a thermally curing component or which is at least free or substantially free from radiation-curing components, and a layer, which substantially consists of a radiation-curing component or which is at least free or substantially free from thermally curing components, can be improved or realized. Said layer, which substantially consists of a radiation-curing component, further may also comprise, for example, hard particles. Preferably, said hard particles have an average grain size of less than 60 micrometers.

A first practical example of said possibilities relates to realizing a print by means of UV inks on a melamine-based primer layer. Until now, it has been known indeed that the adherence of such print on one or more melamine-based primer layers left much to be desired. By applying the material layer of the invention as a transition between the primer layers and the print, an improved adherence of the UV inks can be achieved. According to this practical example, the print then can be finished further with lacquers or with synthetic resins. In this latter case, possibly as a transition between the print layer and the synthetic material layer, again a material layer can be applied which comprises the mixture of the invention, such that in this case, too, a good adherence of the synthetic material finishing layer or layers on the UV inks of the print can be achieved.

A second practical example of said possibilities relates to realizing a melamine-based finishing layer on a printed layer which is realized by means of UV inks. It is clear that the material layer of the invention then is applied at least as a transition above said printed layer and below said finishing layer. Preferably, said melamine-based finishing layer comprises a paper sheet provided with melamine resin, preferably a paper sheet having a surface weight of 10 to 40 grams per square meter. Preferably, the paper sheet is provided with synthetic resin of 40 to 250 grams per square meter dry weight of synthetic resin. The combination of a UV-based printed layer and a melamine-based finishing layer is of particular interest, as in this manner a stable print, in particular, for example, under the influence of sunlight, can be achieved in combination with a hard surface layer. Moreover, it is possible to provide fine structures or relief in a thermo-curing layer, such as a melamine layer, by means of a press treatment, such as with heated matrixes or press plates. Preferably, a discontinuous press device, such as a so-called short-cycle press, is applied for this purpose. The inventors have found that the application of pressures situated between 30 and 60 bar and temperatures between 120 and 230° C. does not lead to any problems for the UV print and effect a good curing of the top layer. Possibly, use can be made of catalysts or curing agents in order to limit the temperature for the curing of the thermally curing finishing layer. Preferably, the thermally curing material of the finishing layer already is subjected to a partial drying treatment before the press treatment is performed, wherein the final curing then is obtained for a major part or entirely in the press device. It is clear that according to this second practical example, also another polycondensation resin can be applied than the melamine resin mentioned herein. Further, it is clear that instead of a finishing layer which comprises a carrier sheet, such as a paper sheet, use can also be made of a finishing layer applied in liquid condition, which, for example, is partially cured, by means of a drying oven prior to obtaining the final curing for the major part or entirely in the press device. Preferably, the finishing layer of this second practical example is provided with hard particles, such as aluminum oxide, preferably having an average grain size situated between 30 and 100 micrometers.

Preferably, said thermally curing component relates to a synthetic resin, preferably a synthetic resin which cures by means of a polycondensation reaction. Such synthetic resin can be selected from the series of urea formaldehyde, melamine, melamine formaldehyde, methane diphenyl diisocyanate, phenol formaldehyde, resorcinol formaldehyde and resorcine phenol formaldehyde. Preferably, the synthetic resin comprises at least melamine or is based thereon.

Preferably, said radiation-curing component relates to a UV or electron beam-curing lacquer.

It is noted that the use of a mixture of synthetic resin and lacquer as such forms an important aspect of the invention, independently from the fact whether the synthetic resin is a thermo-curing agent and/or the lacquer cures by means of radiation. Therefore, it is clear that the invention, according to a second independent aspect thereof, also relates to a method for manufacturing panels of the type which is at least composed of a substrate and a top layer provided on this substrate and comprising a printed decor, wherein the top layer comprises at least two material layers, amongst which a print, wherein the method consists at least of applying said two material layers, wherein said print is performed directly on the substrate material and this print forms at least a portion of said printed decor, with the characteristic that at least in one of said two material layers a mixture is realized which comprises at least a synthetic resin component and a lacquer component. The respective material layer may be applied, for example, for realizing adherence between material layers of different composition. For example, by means of the respective material layer, the adherence can be realized between a layer, which substantially consists of a synthetic resin or which is at least free or substantially free from lacquer components, and a layer, which substantially consists of lacquer or which is at least free or substantially free from synthetic resin components. This can be the case, for example, when a lacquer layer is applied as a surface layer on a panel having a top layer substantially based on synthetic resin. Namely, such lacquer layer can be performed scratch-resistant, when, except lacquer, it further also comprises, for example, hard particles. The respective hard particles preferably have an average particle size which is smaller than 60 μm. Preferably, this relates to flat particles, for example, flat aluminum oxide particles.

Further, it is noted that the mixture of the first and/or the second aspect, according to a deviating third aspect, can also be achieved or applied when impregnating material sheets, for example, paper sheets, which can be applied when manufacturing panels, wherein these panels then are or are not of the above-mentioned type. Herein, the respective material sheet, at one or both flat sides, preferably is provided with a layer of material which consists of the above-mentioned mixture. It is clear that this layer of material possibly can provide for the adherence with underlying or still to be applied material layers. For example, it is possible that such material sheet is applied on a substrate by means of a heated press device and that this substrate further is finished with a lacquer layer. It is clear that such lacquer layer possibly can also be applied on the respective material sheet during the impregnation process. Preferably, such lacquer layer comprises hard particles, such as aluminum oxide and/or silicon carbide. Preferably, these hard particles have an average grain size of less than 60 μm.

The material sheets of the third aspect can be applied as a so-called overlay or as a so-called decor layer, wherein such decor layer then is provided with a printed decor. Such printed decor can be applied either in a step preceding the impregnation, or in a step following the impregnation process of the invention. In this last case, printing can be performed while the respective material sheet already has or has not been provided on the substrate. In this manner, possibly a method of the first and/or of the second aspect can be obtained.

Preferably, said synthetic resin of the second and/or the third aspect is chosen from the series of urea formaldehyde, melamine, melamine formaldehyde, methane diphenyl diisocyanate, phenol formaldehyde, resorcinol formaldehyde and resorcine phenol formaldehyde.

Preferably, said lacquer of the second and/or third aspect is chosen from the series of urea formaldehyde, melamine, melamine formaldehyde, methane diphenyl diisocyanate, phenol formaldehyde, resorcinol formaldehyde and resorcine phenol formaldehyde.

Preferably, said lacquer of the second and/or third aspect is chosen from the series of urushiol-based lacquer, nitrocellulose lacquer, acrylic lacquer, water-based lacquer, epoxy lacquer, maleimide lacquer, UV-curing lacquer and electron beam-curing lacquer.

All preferred embodiments mentioned further below can be applied in connection with the first, the second as well as the third aspect, if not mentioned otherwise.

According to all preceding aspects, the mixture preferably is water-based. Preferably, per 100 parts of weight of the synthetic resin component or thermally curing component, between 3 and 30 parts of weight of the lacquer component are applied. Preferably, per 100 parts of weight of the synthetic resin component or thermally curing component, 5 to 25 parts of weight of water are applied when applying such mixture. Preferably, this water component is practically entirely removed by means of drying treatments and/or curing processes performed in the manufacturing methods of the invention. Of course, it is not excluded that instead of water, a solvent is used, wherein then preferably similar quantity ratios are used as with water. This solvent then also preferably is practically entirely removed by means of drying treatments and/or curing processes performed in the manufacturing methods of the invention.

According to all preceding aspects, preferably at least a portion of said mixture is prepared prior to the application thereof. This means that the respective components, entirely or partly, are applied in the mixed composition. Preferably, the mixed composition is continuously mixed or stirred in order to prevent separation. Preferably, the application of the mixture is realized by means of a technique wherein this mixture is applied in a liquid state. Possibly, the application may be followed, whether or not directly, by a forced drying treatment, for example, by means of one or more hot-air ovens or by means of one or more infrared (IR) or near-infrared radiators (English: near-infrared or N-IR). By "followed directly", it is meant that the drying treatment is performed before one or more further layers are provided on the mixture.

Preferably, at least a portion of said mixture is created during the application thereof, either in the device applied thereby, or on the substrate material, or by a combination thereof. Such embodiment can be achieved according to various possibilities. Below, two practical possibilities will be discussed.

According to a first practical possibility, the mixture is obtained in that both components meet each other in the application device. For example, it is possible that a Venturi effect, induced by the flow of one component, soaks up the other component and mixes it therewith, such that they are provided on the substrate as a mixture. According to this practical possibility, the risk of separation is minimized.

According to a second practical possibility, the mixture is obtained in that one of the components is provided on an already provided, still moist or wet layer of the other component. Herein, at least a border zone or transition layer is created, which comprises a mixture of both components.

Preferably said mixture further also comprises cellulose. Cellulose allows forming a relatively thick material layer with a minimal risk for the occurrence of defects. Moreover, a cellulose-comprising mixture may result in a still better adherence between a layer which substantially consists of a thermally curing component, or at least is free or approximately free from radiation-curing components, and a layer which substantially consists of a radiation-curing component, or at least is free or approximately free from thermally curing components.

In general, it is advantageous to apply cellulose in one or more of the material layers present in the top layer of the panel.

Preferably, the mixture of the invention is free from ink. However, it is not excluded that one or more components of the mixture are applied via the colorant, pigments or ink of the print.

Preferably, said print, according to all aspects of the invention, is performed by means of UV inks. It is clear that the mixture of the invention will be applied in particular in combination with such print. Preferably, the print will be performed by means of a digital printing technique, such as by means of one or more inkjet printheads.

Preferably, the material layer concerned is provided on the substrate prior to the print. Preferably, the material layer concerned thus forms a primer layer for the print. Preferably, the mixture in such case further also comprises pigments, preferably pigments, the color of which is matched to the printed decor. By means of this preferred embodiment, an embodiment according to the also above-mentioned first practical example can be obtained.

Preferably, at least the respective material layer is free from carrier sheets, such as free from paper sheets. Preferably, the entire obtained top layer of the panels is free from such carrier sheets or paper sheets.

Preferably, the method of the first and/or the second aspect provides for one or more primer layers, which are situated below the print, and for one or more transparent or translucent finishing layers, which are situated above the print. The material layer of the invention, which comprises the mixture, can be intended as a primer layer as well as a finishing layer. Of course, it is not excluded that a plurality of the material layers, which are provided on the substrate, comprise such mixture. The application of the aforementioned primer layers, print and/or finishing layers may take place with one or more intermediate drying treatments, sanding or brushing treatments.

Preferably, the majority of said primer layers and/or finishing layers substantially consist of synthetic resin, whereas a minority of these layers substantially is formed of lacquer. Still better, the majority of said primer layers or finishing layers substantially consists of synthetic resin, whereas the print is performed with UV inks. In this last case, the material layer of the invention, in which the mixture is realized, preferably adjoins said print. According to another possibility, the majority of the primer layers, or all primer layers, substantially are composed of UV lacquer, whereas the majority of the finishing layers or all finishing layers substantially are composed of synthetic resin. The material layer of the invention, which comprises the mixture, then preferably is situated at the transition between the lacquer-based and the synthetic resin-based layers.

One or more of said finishing layers preferably is provided with hard particles, such as, for example, aluminum oxide or silicon carbide particles. In this application, by "hard particles" is meant that the respective particles are harder than the material from which the respective finishing layer substantially is composed. This means, for example, harder than the cured synthetic resin and/or the cured lacquer.

Preferably, the particles which are embedded in the finishing layers have an average particle size situated between 200 nanometers and 200 micrometers. Preferably, at the surface of the panel such particles having an average grain size of less than 60 μm and still better of less than 45 μm are embedded. It is possible that instead thereof or in combination therewith, nanoparticles are embedded in the finishing layer on the surface. Preferably, flat particles, for example, flat corundum particles, are situated in the finishing layer on the surface of such panel. In combination with the smaller particles in the finishing layer at the surface, preferably larger particles are embedded in the top layer, at a position where they are situated below these smaller particles, however, above the print. These larger particles preferably have an average particle size of more than 60 μm, and still better of more than 85 μm. As aforementioned, they are preferably smaller than 200 μm and still better smaller than 160 μm.

According to the methods of the invention, the embedding of hard particles in the finishing layers can be performed in various ways. For example, they can be mixed into the material of the respective finishing layer prior to providing the latter on the substrate. According to another example, they are provided on and/or in the respective finishing layer, which is already provided on the panel and which preferably still is moist, by means of, for example, a strewing device. In similar ways, also other components can be embedded in the primer layers and/or finishing layers, such as, for example, cellulose fibers or pigments of any type.

The material layer of the invention, which comprises the mixture, preferably is situated between a layer, which substantially consists of synthetic resin, and a layer, which substantially consists of lacquer and/or ink.

Preferably, the method further also comprises the steps of curing said components. Herein, preferably at least a press treatment by means of a heated press and a radiation treatment are applied. Preferably, the radiation treatment will take place prior to the press treatment. In the press treatment, preferably a structured press element is applied, with which a structure is realized in the top layer of the panels. Preferably, a press device of the short-cycle type is applied (German: Kurztaktpresse). The applied pressures may vary from 3 to 60 kg/cm$^2$. Preferably, a pressure is applied which is situated between 10 and 35 kg/cm$^2$.

Preferably, the mixture comprises one and/or more other material layers comprising a thermally curing component, a catalyst or curing agent. Preferably, per 100 parts of weight of synthetic resin in a respective material layer or mixture, 1 to 10 parts of weight of catalyst are applied. Possibly, the catalyst can be provided on the already provided respective material layer as a separate layer, or can be mixed beforehand into the material of the respective material layer.

In the case of resin comprising melamine and/or urea, an acid or a salt can be applied as a catalyst. For example, maleinic acid, mono butyl phosphoric acid, p-toluene sulfonic acid (PTSA), citric acid, aluminum sulfate, tosylate, ammonium chloride or ammonium sulfate can be used as a catalyst, or a mixture of two or more of these agents.

The application of one or more catalysts, as discussed herein above, allows reducing the required curing temperature of the respective component. Preferably, said catalyst will be added in such an amount that a curing temperature of less than 150° C. is obtained. Still better, a curing temperature of less than 120° C. or even of less than 100° C. is obtained. It is possible to achieve a curing temperature of less than 95° C. Curing at a low temperature has the advantage that less requirements can be made in respect to the temperature resistance of the remaining components of the panel. For example, the temperature can be adjusted such that the differently curing second component or the lacquer component is not or almost not affected. According to another example, the temperature also can be adjusted such that no particular requirements in respect to temperature resistance must be met by the aforementioned print, which is performed directly on the substrate, or by the inks applied therewith.

It is clear that for applying the mixture or the components thereof, all techniques known as such can be employed, such as application techniques using rollers, jetting devices, spraying devices, strewing devices, spreading devices and the like.

It is clear that the invention further also relates to panels which are obtained by means of one or more of the above-mentioned methods.

Generally, the invention, according to a fourth independent aspect, also relates to an alternative panel, which, according to various preferred embodiments, can be manufactured more smoothly and/or offers a solution for the problems associated with panels from the state of the art. To this aim, the invention, according to its fourth independent aspect, relates to a panel of the type comprising at least a substrate and a top layer provided on this substrate, wherein said top layer comprises a motif- or decor-forming print and a transparent or translucent synthetic material layer, which is provided above the aforementioned motif, with the characteristic that said print relates to a digital print formed directly on the substrate and that said top layer comprises a synthetic resin. The inventive idea of combining a digital print with a top layer comprising synthetic resin, offers new possibilities for realizing panels of the type concerned.

Preferably, at least in said top layer a relief is realized, the recesses and/or protrusions of which preferably correspond to said print. Due to the fact that the print is performed digitally and directly on the substrate, the motif can be controlled and is almost not or not subjected to extensions or shrinkage after having been applied. Amongst others, due to this the conformity, which can be achieved with the panels of this fourth aspect, is larger than with traditional laminate panels in which the print is provided in an analogous manner on a paper sheet. During manufacture of a traditional panel, such paper sheet is strongly subjected to dimensional deformations. The dimensional stability of the print and the use of a top layer containing synthetic resin results in that the techniques for applying a structure, which as such are known for traditional laminate panels, can be employed smoothly or even more smoothly for realizing structure in the novel panels of the fourth aspect.

Generally, the panel of the fourth aspect offers the producer of traditional laminate panels a possible smooth transition for manufacturing panels with a print formed directly on the panel, wherein investments can be kept to a minimum.

Preferably, UV inks are applied for performing the print. In such case, the curing of the inks preferably is performed in the printing device itself. Preferably, inks of at least four different colors are applied, such as the basic colors cyan, magenta, yellow and black. Preferably, the applied printing device comprises at least one inkjet printhead per color. Possibly, the number of colors can be extended to more than four. Preferably, this is limited to a maximum of ten different colors. Ideally, 6 or 8 different colors are employed. The respective inkjet printheads can be of the single pass-type or of the multiple pass-type. It is clear that the printing device proposed here can also be applied in the methods of the first, the second and/or the third aspect for performing said print. Further, it is clear that it is not excluded that the applied inks can be water-based inks.

Preferably, said synthetic resin is chosen from the series of urea formaldehyde, melamine, melamine formaldehyde, methane diphenyl diisocyanate, phenol formaldehyde, resorcinol formaldehyde and resorcine phenol formaldehyde.

Preferably, said top layer comprises at least a material layer which is composed of a mixture which comprises at least a synthetic resin component and a lacquer component. It is clear that for this purpose, proceedings may be as in the methods of the first and/or of the second aspect, wherein the practical examples mentioned there can be realized.

Preferably, the panel of the fourth aspect comprises one or more primer layers, which are situated below the print, and one or more transparent or translucent finishing layers, which are situated above the print. Preferably, the majority of said primer layers and/or finishing layers consist substantially of synthetic resin, whereas a minority of these layers can be composed substantially of lacquer and/or of the print. Preferably, at least all finishing layers consist substantially of synthetic resin. One or more of said finishing layers preferably is provided with hard particles, such a, for example, aluminum oxide or silicon carbide particles. Preferably, the particles which are embedded in the finishing layers have an average particle size situated between 200 nanometers and 200 micrometers. Preferably, at the surface of the panel such particles are embedded having an average grain size of less than 60 μm and still better of less than 45 μm. It is possible that instead thereof or in combination therewith, nanoparticles are embedded in the finishing layer at the surface. Preferably, flat particles, for example, flat corundum particles, are situated in the finishing layer at the surface of such panel. In combination with the smaller particles in the finishing layer at the surface, preferably larger particles are embedded in the top layer at a position where they are situated below these smaller particles, however, above the print. These larger particles preferably have an average particle size of less than 60 μm, and still better of less than 85 μm. As aforementioned, preferably they are smaller than 200 μm and even still better smaller than 160 μm.

Preferably, said print is performed by means of inks which comprise synthetic resin. By means of such inks, the adherence to the synthetic resin of the top layer can be increased. Such inks can also be applied in said first, second and/or third aspect. Preferably, in these aspects, however, melamine-free or approximately melamine-free inks are applied.

Preferably, said top layer comprises an UV blocker. The use of an UV blocker results in a higher color stability of the print formed directly on the substrate. The use of such UV blocker is interesting in all aspects of the invention.

Preferably, said top layer comprises remainders of a catalyst or curing agent. This relates, for example the catalysts or curing agents mentioned in the first or second aspect.

Preferably, said top layer is paper-free. In this manner, an inexpensive panel is obtained. It is clear that the top layer of the panels which are realized by the methods of the first and/or the second aspect preferably also are realized paper-free or even material sheet-free as well.

BRIEF DESCRIPTION OF THE DRAWINGS

With the intention of better showing the characteristics of the invention, hereafter, as an example without any limitative character, some preferred embodiments are described, with reference to the accompanying drawings, wherein.

DESCRIPTION OF NON-LIMITING EMBODIMENTS

Figure 1:
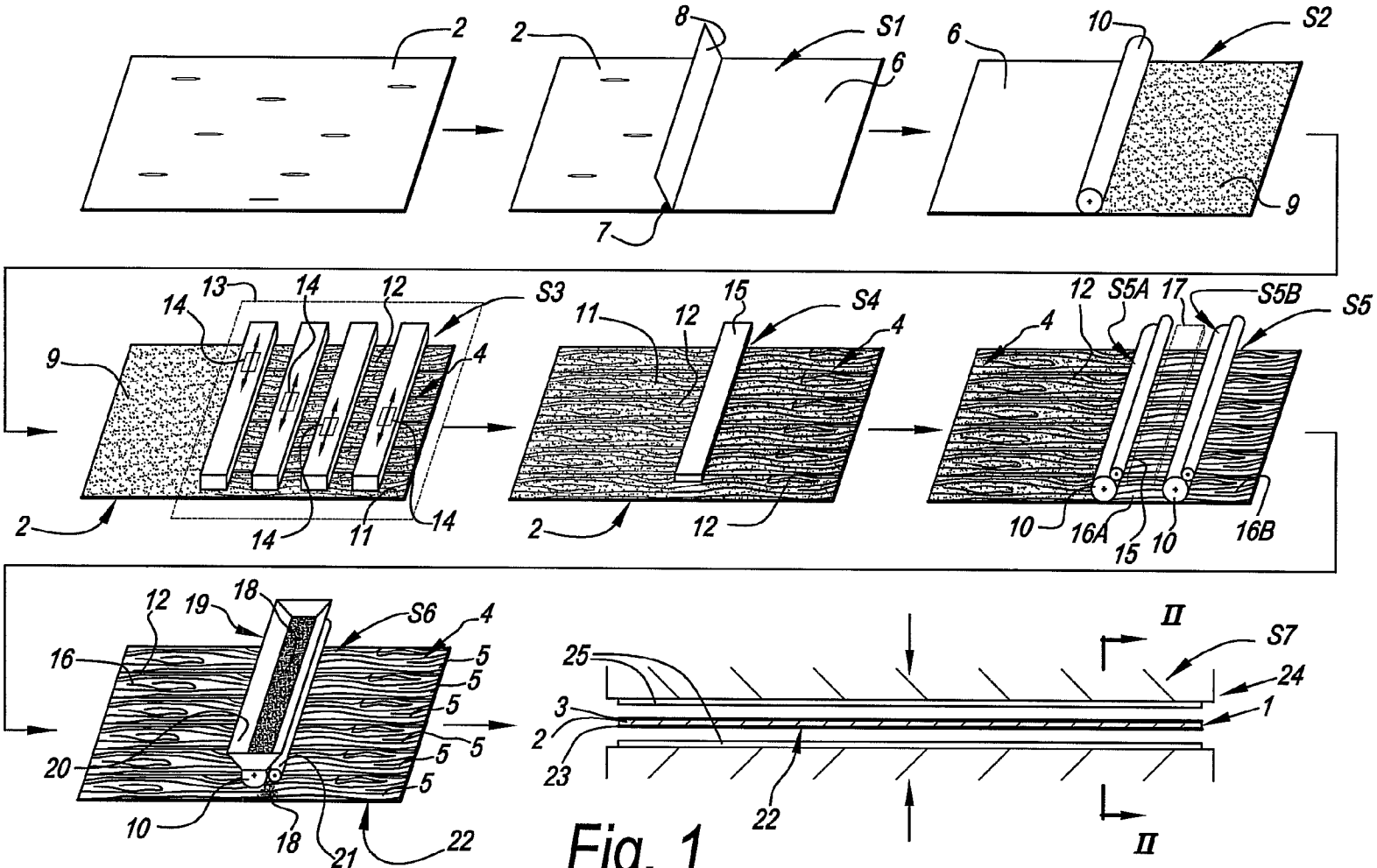
FIG. 1 schematically represents a method according to a non-limiting embodiment of the invention.

FIG. 1 represents some steps S1-S7 from a method for manufacturing panels or boards 1, with the characteristics of, amongst others, the first aspect of the present invention. Herein, this relates to a method for manufacturing panels or boards 1 of the type which is composed at least of a substrate 2 and a top layer 3 provided on this substrate 2 and comprising a printed decor 4. In the example of FIG. 1, specifically a method is illustrated for manufacturing floor panels 5 comprising a wood-based substrate 2, such as a substrate 2 on the basis of MDF or HDF. For the person skilled in the art, it is clear how a similar method for manufacturing other panels, such as ceiling panels or furniture panels, can be obtained.

For manufacturing, it is started from larger boards 1, from which, in a dividing step not represented here, a plurality of said panels 5 can be formed. In the example of the method of FIG. 1, possible unevennesses at the surface of the larger board 1 are removed in a first step S1 by means of a material layer 6 with filling agent 7. In the example, the filling agent 7 is provided on the surface of the board 1 by means of a doctor blade 8 or other spatula in order to obtain a smooth surface. Possibly, this first material layer 6 can be sanded in order to obtain the desired surface condition. A sanding operation may also be performed prior to providing the filling agent. Such sanding operations are not represented here. In the example, in a second step S2 still at least a second material layer 9 is provided on the surface of the larger board 1. Herein, this relates to a primer layer 9 of a substantially uniform color, which is provided by means of at least one roller 10.

It is clear that in the example of FIG. 1 the aforementioned first material layer 6 as well as the aforementioned second material layer 9 are provided in liquid form. They may also be applied in several partial layers, which are or are not dried and/or sanded in between. The respective material layers 6-9 can be of any composition. For example, they may be composed substantially of lacquer or synthetic resin. In the case of a primer layer 9 provided in the second step S2, the aforementioned composition preferably comprises pigment, too.

Of course, the material layers 6-9 of the first step S1 and the second step S2 can be provided in any manner. Preferably, they are applied in liquid form.

In a third treatment step S3, a material layer 11 is provided in the form of a print 12, which is performed directly on the substrate material 2. This print 12 forms at least a part of the printed decor 4 of the final panels 5. The represented print 12 relates to a print with a wood pattern. As represented, it is possible that said primer layer 9 co-determines the appearance of the panel 5 or the board 1. In the example, the print 12 is performed by means of a digital printing device 13, such as by means of an inkjet printing device. In the example, the printing device 13 comprises at least four inkjet printheads 14. Each of the four represented inkjet printheads 14 here is responsible for applying ink of a specific color, by which a multi-color print can be obtained. Preferably, the inkjet printing device 13 is of the so-called multi-pass principle, wherein a well-defined printhead 14 moves several times over the surface to be printed of the board 1. During such pass, the respective substrate 2 or the respective board 1 preferably is kept still. In between two passes, the printheads 14 and/or the substrate 2 or the board 1 can be moved, with the intention of printing, in a subsequent pass, another part of the surface of the board 1. This movement can be similar, equal to or smaller than the distance between two points of the print part provided in a preceding pass. In this manner, it can be obtained that the printing points of the print part still to be performed are provided in the following pass in between the printing points of the print part of one or more preceding passes. Of course, it is not excluded to work with printheads that stand still and/or with the so-called single-pass principle, wherein a respective substrate 2 or a respective board 1 is provided with a print 12 in a single movement. For a more detailed description of the single-pass principle, reference is made to EP 1 872 959.

In the represented example, the print 12 is performed by means of UV inks, which in this case in a separate step S4 are dried and/or cured at least partially by means of one or more UV light sources 15. Such light source possibly may be integrated in the printing device 13 or at one or more of the printheads 14. By means of such embodiment, the step S4 can be performed approximately simultaneous to the step S3. According to the invention, however, it is, of course, not excluded to work with water-based inks, wherein any drying treatment then preferably takes place by means of an IR source or a hot-air oven.

In a fifth treatment step S5, a translucent or transparent synthetic material layer 16 is applied, which, in the final floor panel 5, will be situated above the material layer 11 which is provided by means of a print 12. In the example, the respective synthetic material layer 16 consists of two separately applied material layers 16A-16B.

In a first partial step SSA, namely in a first material layer 16A a mixture is realized, which contains at least a thermally curing component, for example, melamine-based resin, and a radiation-curing component, for example, an UV lacquer. In this case, the aforementioned mixture is mixed prior to the application thereof. In the example, the application as such is performed by means of rollers 10. Of course, other application techniques are not excluded. As represented in dashed line 17, possibly a drying operation or a curing operation can be applied on this first material layer 16A, for example, on the radiation-curing component thereof.

In a second partial step SSB, a second material layer 16B is applied, which substantially consists of a thermally curing component, for example, of a melamine-based resin. Here, too, application is performed by means of rollers 10, although other techniques are not excluded, either. For example, this second material layer 16B can also be applied by means of a technique wherein the component concerned is provided on a carrier sheet, such as on a paper sheet, and afterwards is provided on the substrate 2 by means of the carrier sheet. The carrier sheet concerned can remain present in the final coated panel.

Said first material layer 16A, which comprises the mixture, provides for the adherence between the second material layer 16B and the print 12, which latter is performed by means of UV inks.

Other techniques for applying the material layers 6-9-16 of the first, second and/or fifth step are, for example, techniques making use of spraying or jetting devices or application techniques which use negative pressure.

In a sixth treatment step S6, in the example hard particles 18 are provided on the still moist or wet synthetic material layer 16, in this case by means of a strewing device 19. Such strewing devices 19 are known as such, for example, from GB 1,003,597 or GB 1,035,256. Herein, the hard particles 19 are placed from a recipient 20 onto a roller 10, such as an anilox roller, from which they then are removed again by means of a brush 21. In this case, a rotating brush is represented; however, a to- and fro-moving brush can be used as well. For the hard particles 18, use can be made of aluminum oxide particles having an average It is possible that after said sixth treatment step S6, the partial step S5B and possibly the sixth step S6 still are repeated one or more times, whether or not with intermediate drying operations. In such case, it is possible that the average particle size of the hard particles 18 is chosen smaller when they are provided in a layer which is situated closer to the final surface.

It is clear that such separate sixth step S6 is optional. Namely, one may work without hard particles 18, or with techniques in which the hard particles 18 are blended into the material which is applied in the partial steps S5A and/or S5B. In the case that in the partial step S5B, use is made of a carrier sheet, the hard particles 18 can also be provided on this carrier sheet, prior to the application thereof on the substrate.

Further, it is clear that the schematic steps represented in FIG. 1 can form part of a method with the characteristics of the second practical example mentioned in the introduction.

It is possible that at the underside 22 of the substrate 2 or the board 1 one or more of the above-mentioned layers and/or other layers are provided. Preferably, at least one material layer 23 is provided, which realizes a water- and/or vapor-proofing action at the underside 22 of the board 1 or the panels 5 obtained therefrom.

In a seventh treatment step S7, the substrate 2, which is provided with the material layers 6-9-11-16-23, is brought into a heated press device 24, where it is pressed between press elements 25. In this case, a short-cycle press is represented schematically. However, a continuous press device can also be used, wherein belt-shaped press elements are applied instead of plate-shaped press elements 25, as represented here. During the press treatment S7, the curing of the thermally curing component or the synthetic rein will take place at least partially.

Figure 2:
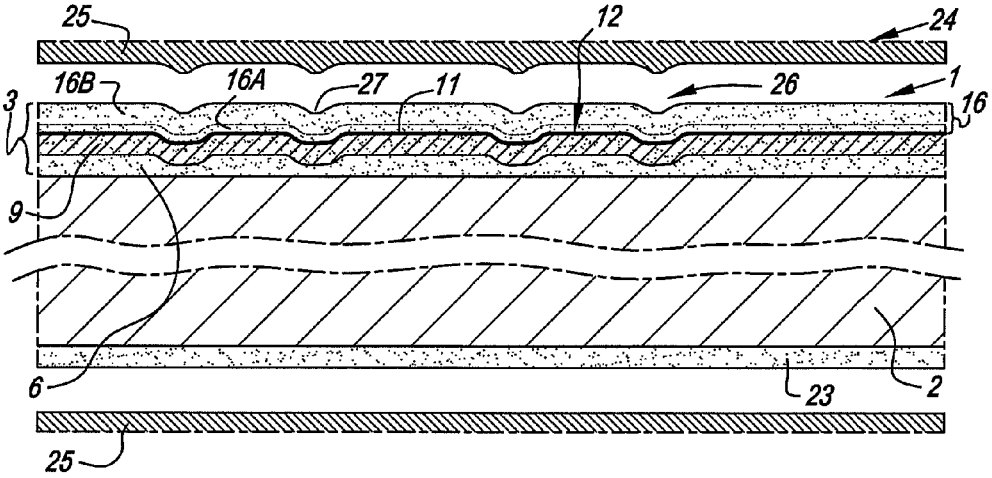
FIG. 2, in cross-section and at a larger scale, represents a view according to the line II-II represented in FIG. 1.

FIG. 2 represents the result of such press treatment S6. It is represented clearly that in the surface of the board 1, more particularly in the material layers 6-9-11-16, which are provided thereon, a relief 26 can be realized. This is possible, for example, as one or both press elements 25 from FIG. 1 are made structured and will press this structure, during the press treatment S6, into the surface of the board 1 or the material layers 6-9-11-16 provided at that location. Preferably, this relates to a relief 26, the recesses and/or protrusions of which correspond to the print 12. As represented, the impressions 27 realized by means of the press element may manifest themselves in one or more of the material layers 6-9-11-16 provided on the board 1. Preferably, the substrate 2 as such is not deformed, although this is not excluded. Of course, it is also not excluded that at least the print 12 remains un-deformed and that the impressions 27 thus manifest themselves exclusively or substantially in one or more of the material layers 16, or finishing layers, which are provided above the print 12.

It is clear that it is not necessary for the method of the invention that all steps S1-S7 represented in FIG. 1 are applied. The essence of the method of the invention in fact consists in that in at least one material layer 16A, a mixture is realized which comprises at least a thermally curing component and a radiation-curing component, and/or that in at least one material layer 16A, a mixture is realized which comprises at least one synthetic resin component and a lacquer component.

Also, it is clear that still other layers than those illustrated by means of FIG. 1 can be applied and that for providing the different material layers 6-9-11-16-23, other techniques can be applied as well.

As aforementioned, the larger boards 1, in a further not represented dividing step, can be divided into a plurality of smaller panels 5, which have approximately the dimensions of the final panels 15. This may take place, for example, by means of a multi-blade saw.

Figure 3:
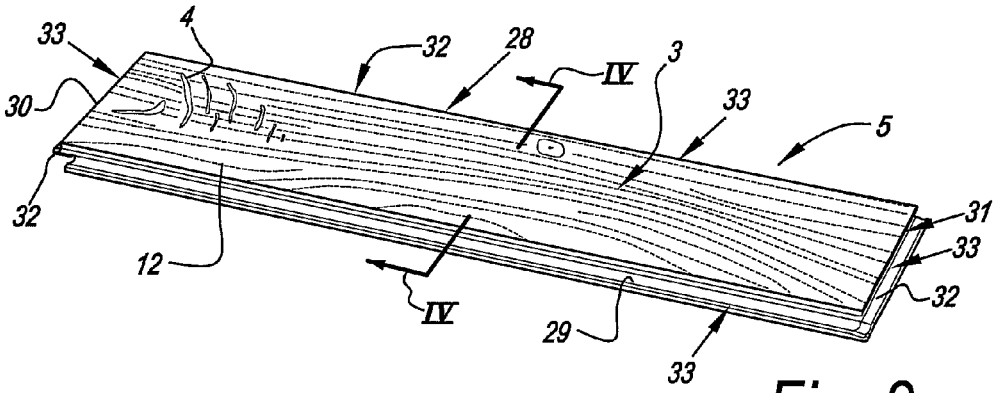
FIG. 3 represents a panel, more particularly a floor panel, according to a non-limiting embodiment of the invention.

FIG. 3 represents that the obtained rectangular panels 5, possibly at least at two opposite edges 28-29, and in this case at both pairs of opposite edges 28-29-30-31, can be provided with profiled edge regions 32, which comprise, for example, coupling means 33, with which two of such panels 5 can be coupled to each other. The treatment step in which the possible profiled edge regions 32 are realized, is not represented here. Such treatment step may be performed at any time after performing said dividing step.

Figure 4:
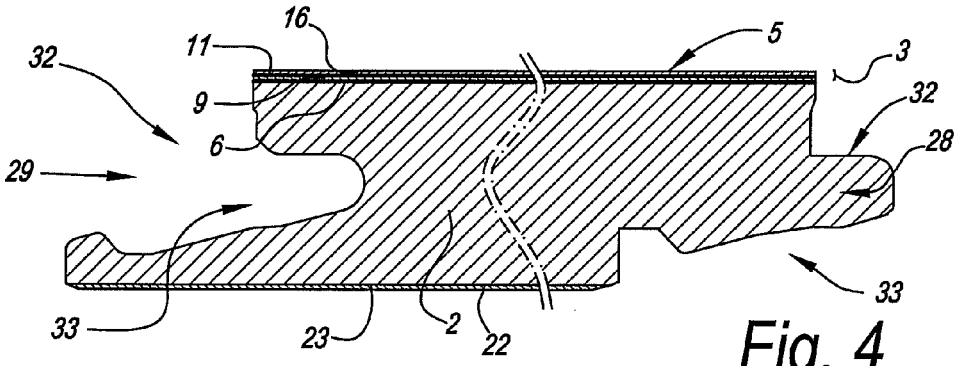
FIG. 4, in cross-section and at a larger scale, represents a view according to the line IV-IV represented in FIG. 3.

FIG. 4 represents an example of such coupling means 33. For further examples, reference is made to WO 97/47834.

It is also noted that the thickness of the layers 6-9-11-16A-16B-16 in the figures is represented only schematically and must not be seen as restrictive.

Further, it is clear that the floor panel 5, which is represented in the FIGS. 3 and 4, also shows the characteristics of the fourth aspect of the invention.

The present invention is in no way limited to the herein above-described forms of embodiment; on the contrary, such methods and panels can be realized according to various variants, without leaving the scope of the present invention.

The invention claimed is:

1. A method for manufacturing panels of the type which is at least composed of a substrate and a top layer provided on the substrate, the top layer including at least two material layers, wherein at least one of the material layers is a print, the method comprising:

applying the two material layers, such that the print is performed directly on the substrate and the print forms at least a portion of a printed decor;

wherein at least one of the two material layers includes a mixture of at least a thermally curing component and a radiation-curing component;

wherein the mixture is obtained by forming a border zone on the substrate;

wherein the border zone is formed by providing a first one of the components on the substrate, and then providing a second one of the components on the first one of the components; and wherein at least a portion of the mixture is created during its application on the substrate.

2. The method of claim 1, wherein the thermally curing component is a synthetic resin.

3. The method of claim 2, wherein the synthetic resin cures by polycondensation.

4. The method of claim 3, wherein the synthetic resin contains melamine.

5. The method of claim 1, wherein the radiation-curing component is a UV- or electron beam-curing lacquer.

6. A method for manufacturing panels of the type which is at least composed of a substrate and a top layer provided on the substrate, the top layer including at least two material layers, wherein at least one of the material layers is a print, the method comprising:

applying the two material layers, such that the print is performed directly on the substrate and the print forms at least a portion of a printed decor;

wherein at least one of the two material layers includes a mixture having at least a synthetic resin component and a lacquer component;

wherein the mixture is obtained by forming a border zone on the substrate;

wherein the border zone is formed by providing a first one of the components on the substrate, and then providing a second one of the components on the first one of the components; and wherein at least a portion of the mixture is created during its application on the substrate.

7. The method of claim 6, wherein the synthetic resin is selected from the group consisting of urea formaldehyde, melamine, melamine formaldehyde, methane diphenyl diisocyanate, phenol formaldehyde, resorcinol formaldehyde and resorcine phenol formaldehyde.

8. The method of claim 6, wherein the lacquer is selected from the group consisting of urushiol-based lacquer, nitrocellulose lacquer, acrylic lacquer, water-based lacquer, UV-curing lacquer and electron beam-curing lacquer.

9. The method of claim 6, wherein the mixture further comprises cellulose.

10. The method of claim 6, wherein the print is performed using UV inks.

11. The method of claim 6, further comprising curing the two material layers.

12. A method for manufacturing panels of the type which is at least composed of a substrate and a top layer provided on the substrate, the top layer including at least two material layers, wherein at least one of the material layers is a print, the method comprising:

applying the two material layers, such that the print is performed directly on the substrate and the print forms at least a portion of a printed decor;

wherein at least one of the two material layers includes a mixture of at least a thermally curing component and a radiation-curing component;

wherein the mixture is obtained by forming a border zone on the substrate;

wherein the border zone is formed by providing a first one of the components on the substrate, and then providing a second one of the components on the first one of the components; and wherein the material layer including the mixture is provided on the substrate prior to the print.

13. The method of claim 12, wherein the thermally curing component is a synthetic resin.

14. The method of claim 13, wherein the synthetic resin cures by polycondensation.

15. The method of claim 14, wherein the synthetic resin contains melamine.

16. The method of claim 12, wherein the radiation-curing component is a UV-or electron beam-curing lacquer.

17. A method for manufacturing panels of the type which is at least composed of a substrate and a top layer provided on the substrate, the top layer including at least two material layers, wherein at least one of the material layers is a print, the method comprising:

applying the two material layers, such that the print is performed directly on the substrate and the print forms at least a portion of a printed decor;

wherein at least one of the two material layers includes a mixture having at least a synthetic resin component and a lacquer component;

wherein the mixture is obtained by forming a border zone on the substrate;

wherein the border zone is formed by providing a first one of the components on the substrate, and then providing a second one of the components on the first one of the components;

and wherein the material layer including the mixture is provided on the substrate prior to the print.

18. The method of claim 17, wherein the synthetic resin is selected from the group consisting of urea formaldehyde, melamine, melamine formaldehyde, methane diphenyl diisocyanate, phenol formaldehyde, resorcinol formaldehyde and resorcine phenol formaldehyde.

19. The method of claim 17, wherein the lacquer is selected from the group consisting of urushiol-based lacquer, nitrocellulose lacquer, acrylic lacquer, water-based lacquer, UV-curing lacquer and electron beam-curing lacquer.

20. The method of claim 17, wherein the mixture further comprises cellulose.

21. The method of claim 17, wherein the print is performed using UV inks.

22. The method of claim 17, further comprising curing the two material layers.

* * * * *